US005873202A

United States Patent [19]

Parks

[11] Patent Number: 5,873,202

[45] Date of Patent: Feb. 23, 1999

[54] SLIDABLY ADJUSTABLE RIGID AWNING

[76] Inventor: Charles Sherman Parks, P.O. Box 127, Greenwood, Del. 19950

[21] Appl. No.: 888,513

[22] Filed: Jul. 7, 1997

[51] Int. Cl.[6] ..... E04B 1/34

[52] U.S. Cl. ..... 52/73; 52/78; 49/74.1; 49/77.1

[58] Field of Search ..... 52/73, 74, 75, 52/473, 78; 49/74.1, 77.1

[56] References Cited

U.S. PATENT DOCUMENTS 2,791,009 5/1957 Wagner ..... 49/77.1

3,396,496 8/1968 Roberts ..... 52/75

3,500,583 3/1970 McKinnon ..... 49/77.1

*Primary Examiner*—Creighton Smith

[57] ABSTRACT

The invention is an improved rigid awning structure which permits some regulation of pass-through light and which may be constructed attached to a building or free standing. The invention provides slated louver sets arranged one above the other in banks of at least two sets. At least one of the louver sets in each bank is slidably movable to achieve the regulation of pass through-light. The invention may be constructed utilizing many conventional frame building methods and materials.

7 Claims, 2 Drawing Sheets

SLIDABLY ADJUSTABLE RIGID AWNING

BACKGROUND-FIELD OF INVENTION

The invention relates to rigid type awnings, either free standing or attached to buildings. More specifically, it relates to rigid awning that can be adjusted to regulate the amount of light which passes through them.

BACKGROUND-DESCRIPTION OF PRIOR ART

There are many situations in which it is desirable to provide protection from the direct rays of the sun and/or some reduction in the amount of light that strikes a particular surface. Such shading (protection from direct sun light and/or reduction of light) is often sought for windows, porches and decks, particularly south facing ones. Also, there is often a need for such shading of patios, picnic areas and horticultural garden plots. In some applications it is desired that there be protection from rain as well a reduction of light. In some applications it is desirable that shading be provided while permitting free air passage for ventilation. In some applications it is desirable that there be some means for regulating the degree of shading in response to charging weather conditions, seasons and use to be made of the shaded area.

In the prior art several types of awnings have been produced in an attempt to meet the afore mentioned needs. Soft, flexible type awnings are usually made of canvas or similar material. Many such awnings can be extended and retracted by folding or rolling. When extended, awnings of this type provide a fixed degree of shade and often rain protection for a defined area. When partially folded or rolled they provide the same degree of shade and rain protection for a smaller area. But they do not provide any way to regulate the degree of shade or light transmittal to an area. Neither do they allow for much pass through of air for ventilation.

Rigid awnings are also shown in the prior art. Some rigid awnings (e.g. U.S. Pat. No. 3,417,519 to Hitter on Dec. 24, 1968 and U.S. Pat. No. 4,411,109 to Struben on Oct. 25, 1983) provide good protection from both rain and direct sun, but provide no ventilation and no way to regulate the degree of shade and pass-through light. Other rigid awnings (e.g. U.S. Pat. No. 595,715 to Vetere on Apr. 5, 1960 and U.S. Pat. No. 3,729,874 to Albany on May 1, 1973) provide shade, ventilation and rain protection but no way to regulate the amount of shade and pass-through light.

Ventilated, rigid awnings which do permit the regulation of pass-through light are taught by Corduan (U.S. Pat. No. 47,524 on May 2, 1865), Teupe (U.S. Pat. No. 396,309 on Jan. 15, 1889) and Chrosnik (U.S. Pat. No. 2,597,225 on Sep. 25, 1948). In these devices the regulation of pass-through light is accomplished by moving a plurality of individually hinged or pivoted louver slats.

SUMMARY OF THE INVENTION

My invention provides a ventilated, rigid awning which permits the regulation of pass-through light. For applications where rain and snow protection is desired in an awning the louver sets of my invention may be applied in conjunction with translucent or transparent roofing materials to shed rain and snow.

My invention is superior to the prior art because it provides a rigid awning utilizing two or more sets of louvers with fixed slats. These are mounted one above the other with at least one being slidably movable. The regulation of pass-through light is accomplished by changing the position of these louver sets in relationship to one another by a sliding movement. This method of regulating pass-through light does not require that individual slats be hinged or pivoted. Therefore, because there are fewer moving parts, construction is much simpler and more economical.

The louver sets which my invention incorporates in an awning structure can be manufactured in a shop or factory, or they can be manufactured at building sites by building crews. They are designed to be installed between horizontal or angled rafters of awning structures built using conventional construction materials and conventional construction techniques well known to those trained in the building art. They are selectively sized to fit between horizontal or angled (sloping) upstanding rafter members of an awning structure having conventional frame building components and design. Such structures may be free standing or attached to a house or other building.

Free standing awning structures of my invention may be used to provide shade in a garden, picnic area or horticultural nursery lot. These structures may have such conventional frame building components and design as horizontal or sloped, upstanding rafter members resting on and secured to support beams which in turn rest on vertical pillars or posts which are embedded into the ground or otherwise secured at the base.

Awning structures attached to a building to provide shade for a porch, patio, deck or window may also utilize slidably adjustable louver sets of my invention. The conventional components of such awning structures consist of horizontal or downward sloping rafters attached at one end to the building via a header and having the other end resting on and attached to a beam which in turn rests on vertical posts. Instead of vertical posts, the beam may also be supported by braces angled inwardly toward the building and attached to the side thereof. Selectively sized, slide adjustable louver sets are fitted between the upstanding rafter members.

Other special features of the components and structure of the present invention which facilitate the regulation of light transmission through an awning and provide for ease of construction by conventional methods known in the art are described hereinafter in the specification of the preferred embodiments.

Accordingly, the advantages and objects of my present invention are that it provides an awning or sun shade which can:

(a) be adjusted to regulate the amount of light that passes through it, (b) be constructed on site by the carpenters of building crews, (c) be adjusted to control light passage without the expense of individually pivoted or hinged louver slats, (d) be constructed from different kinds of rigid materials such as wood, metal or plastic, (e) be constructed in attachment to a building to provide shade for a porch, deck or window; or in a free standing arrangement to provides a shaded area in a yard, garden, or horticultural lot, (f) be constructed in a horizontal position or in a sloping, angled position, (g) be constructed in conjunction with transparent of translucent roofing materials such a fiberglass when protection from rain and snow is desired as well as control of pass-through light, (h) be constructed of materials which will match and be aesthetically compatible with wood deck structures.

Other objects and advantages will be apparent from the drawings and specification.

Reference Numerals in Drawings

| | | | | | |
|---|---|---|---|---|---|
| 10 | slat | 12 | stringer | 14 | nail or screw |
| 16 | header | 18 | rafter | 20 | beam |
| 22 | vertical post | 24 | side of house | 26 | stringer rest |
| 28 | lever | 30 | support rod | 32 | connecting link |
| 34 | anchor | 36 | rear stop | 38 | front stop |
| 40 | brace | 42 | trim board | 44 | furring strip |
| 46 | translucent roofing material | | | 48 | roofing material fastener |
| 50 | pin | 52 | slot | | |

Figure 1:
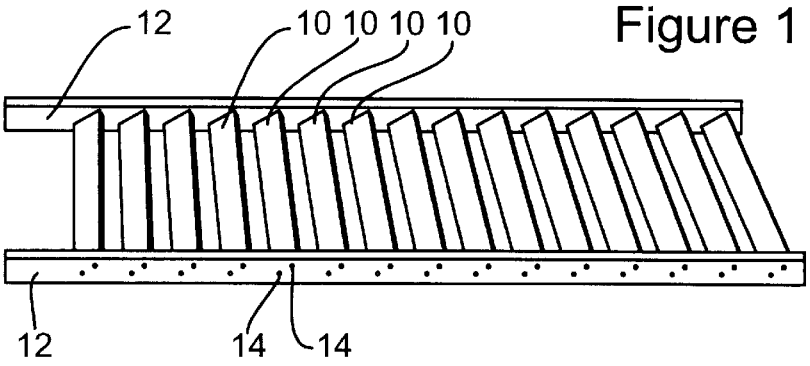
FIG. 1 shows a perspective view of a single louver set.

Referring now to the drawings and particularly to FIG. 1, upstanding stringers 12 are parallel to one another. The plurality of slats 10 are attached parallel to one another and perpendicular to stringers 12 with nails or screws 14.

The angle of pitch, the width, and the spacing of slats 10 are predetermined and selective. They are determined by considering the angle (slope) of the awning structure in which the louver set will be applied, the latitude of the building site, the north-south directional orientation of the awning structure and the amount of contrast desired between the maximum and minimum adjustable amount of pass-through light.

For south oriented awnings in the temperate zone (northern hemisphere) it is generally desirable to be able to maximize the amount of sun light/heat that passes through the awning during the winter season and minimize same during summer. When such is the case, it is preferred that in a horizontal awning structure oriented due south (temperate zone, northern hemisphere) the angle of the slats be generally the same as the angle of the low winter sun. When thus constructed an adjustment is possible wherein the amount of midday winter pass-through light is restricted only by the thickness of the louver slats. This is the case when the slidably movable louver set(s) are positioned so that the top and bottom surfaces of the slats of all louver sets within a bank are aligned in the same plane one with another. In this position slats are edgewise toward the midday winter sun and the slats of the lower set(s) are in the shadow of the slats of the topmost set(s). Therefore, the amount of pass-through sun light/heat is maximized. In the summer season total shade from the overhead sun is also attainable if the width of the slats is slightly greater than the spaces between the slats.

Figure 2:
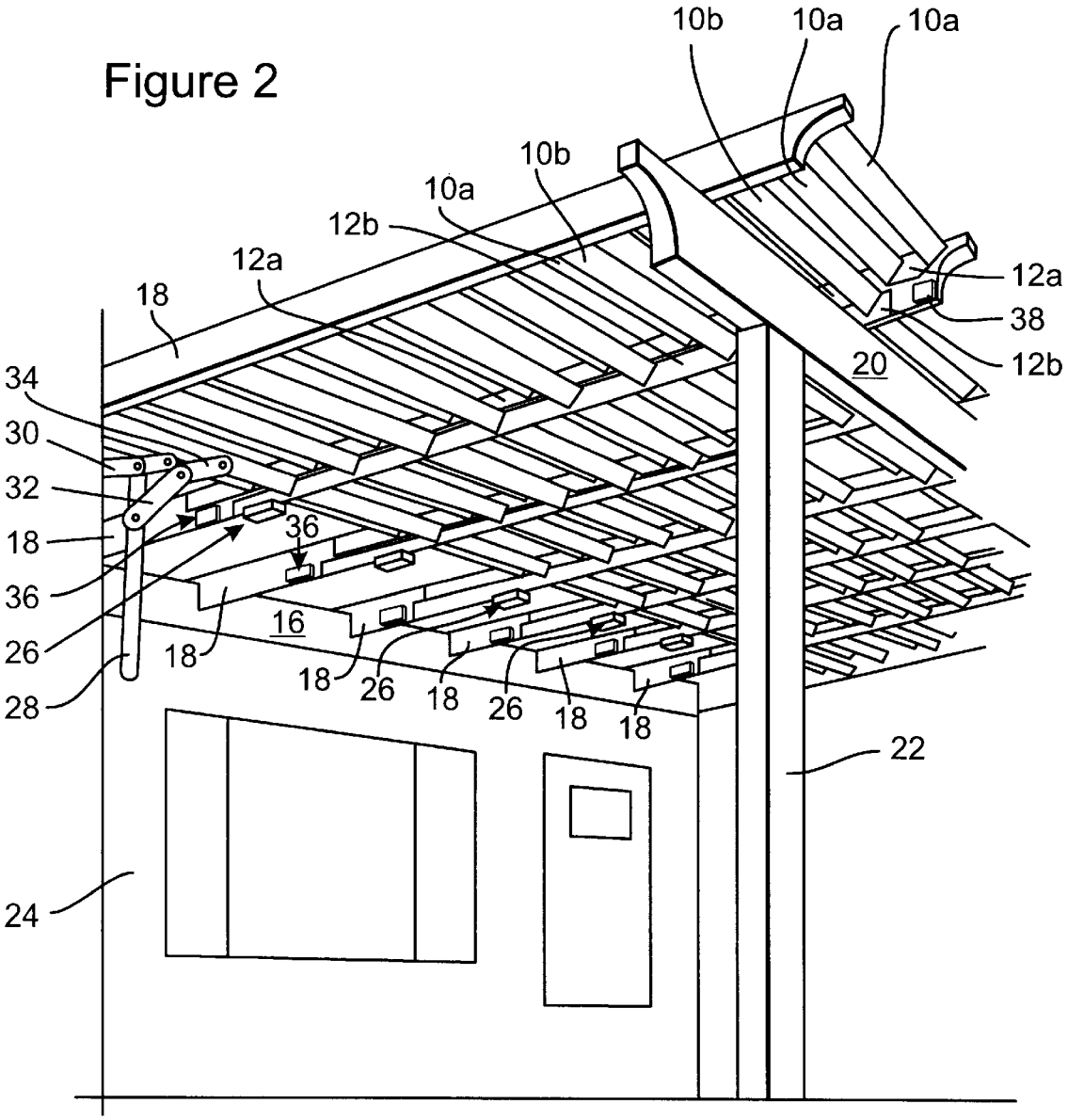
FIG. 2 shows an perspective view of an awning structure with a plurality of rafters attached horizontally to the side of a house and incorporating, between rafters, banks of two louver sets with the upper louver set of each bank fixed and the slidably movable lower louver set of each bank in an open position to allow much pass-through light.
Figure 3:
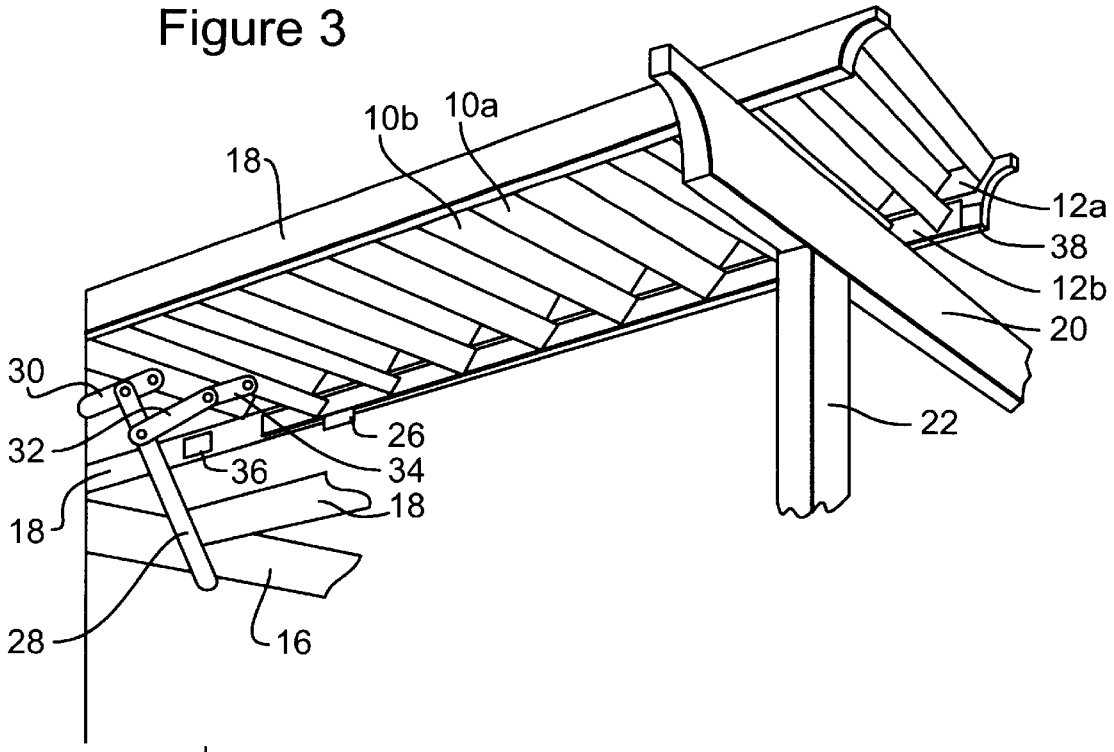
FIG. 3 shows the foremost section of FIG. 2 with the lower, slidably movable louver set in a closed position thus restricting much pass-through light.

Turning now to FIG. 2 and FIG. 3, the conventional components of the structure therein shown include: header 16, plurality of rafters 18, beam 20, and vertical post 22. The assembly and function of these component are known to those versed in the art.

Header 16 is attached to house side 24 by lag bolts or other fasteners. Plurality of rafters 18 are attached at one end to header 16 by nails or hardware fixtures. The other end of rafters 18 rests on beam 20 and is attached thereto by nails or hardware fixtures. Beam 20 rests on, is supported by and attached to post 22. Post 22 is firmly embedded in the ground or otherwise suitably secured at the base. Additional posts 22 needed for the support of beam 20 are not shown in the drawing.

Inserted between the plurality of rafters 18 shown in FIGS. 2 and 3 are banks of two louver sets. Each bank thereof consists of a stationary, fixed upper louver set and a slidably movable lower louver set.

The top edges of the upper louver set stringers 12*a* are positioned generally flush with the top edges of rafters 18. Stringers 12*a* fit snugly between rafters 18 and are secured to the side thereof with nails or screws.

Slats 10*b* of the lower louver set are slightly shorter (About ¼ inch shorter is preferred when ¾ inch building lumber is the material of construction) than upper louver slats 10*a*. Therefore, stringers 12*b* fit loosely between rafters 18. This allows the lower louver set to move freely between rafters 18 in a sliding manner. Lower louver set stringers 12*b* rest unattached on beam 20 and on stringer rests 26.

Stringer rests 26 are pieces of lumber or other firm material attached with screws or other fasteners to the under edge of rafters 18. They are of sufficient size so as to extend beyond the thickness of rafter 18 far enough to provide a solid ledge upon which louver set stringers 12*b* will rest. It is preferred that stringer rests 26 extend beyond the edges of rafters 18 about one inch when ¾ inch lumber is the material of construction.

Lever 28 is pivotally attached to support rod 30. Support rod 30 is secured to the side of the house and/or to the inner most slat 10*a* of the upper louver set. Thus secured, support rod 30 is stationary. Connecting link 32 is pivotally connected to lever 28 at one end and pivotally connected to anchor 34 at the other end.

Anchor 34 is fixedly attached with screws or other fasteners to the innermost slat 10*b* of the lower louver set. When lever 28 is pushed away from the house the lower louver set moves forward. When lever 28 is moved toward the house the lower louver set moves rearward. In this way slats 10*b* in the lower louver set can be moved to any position from directly under slats 10*a* of the upper louver set to directly between slats 10*a*. The amount of pass-through light can be regulated in this way.

When slats 10*b* are positioned directly under slats 10*a*, the amount of pass-through light from the overhead sun is maximized. In FIG. 2 slats 10*b* are positioned almost directly under slats 10*a*.

When slats 10*b* are centered under the spaces between slats 10*a*, as in FIG. 3, the amount of pass-through light from the overhead sun is minimized. In this position total shade can be attained from the overhead sun if slats 10*b* are sized to be slightly larger than the spaces between slats 10*a*.

Although it is not essential, it is preferred that rear stop 36 and front stop 38 be provided to define the most rearward and most forward positions to which the lower louver set can be slid.

Stops 36 and 38 are blocks of wood or other firm material attached to the sides of rafters 18 at a predetermined location in the path of stringers 12*b* of the sliding lower louver set. Stops 36 and 38 being fixedly attached with nail or screws to sides of rafters 18 will serve to stop the rearward and forward motion of stringer 12*b* when sliding stringers 12*b* make contact therewith.

It is to be understood that although only one lever 28 with its companion parts (support rod 30, link 32 and anchor 34) are shown in FIGS. 2 and 3, one such assembly is required for each bank of louver sets installed between rafters.

The preferred embodiment of my invention as shown in FIGS. 2 and 3 has a bank of two louver sets with upper set fixed and lower set movable. However, the awning could also be constructed with both sets movable, and having levers arranged to move one set forward while moving the other set rearward. Also, the lower set could be fixed and the upper set movable. Additional louver sets could be included in each bank.

The embodiment of my invention as shown in FIGS. 2 and 3 has rafters positioned horizontally from the side of the building and has no provision for protecting the area underneath from rain and snow. It should be understood that such a structure might also have rafters sloped downwardly from the building and might be constructed in conjunction with translucent or transparent material to shed rain and snow.

Though I have shown a simple lever device in FIGS. 2 and 3 to be used for slidably moving the movable louver set(s), it is understood that other devices such as gears or pulleys could also be used for that purpose. Motorized as well as manual devices could be used for moving the movable louver set(s) for the adjustment of pass-through light. The use of photocells in conjunction with a motorized system could be use to achieve automatic movement of louver set(s) to maintain either maximum pass-through light or maximum shade.

Figure 4:
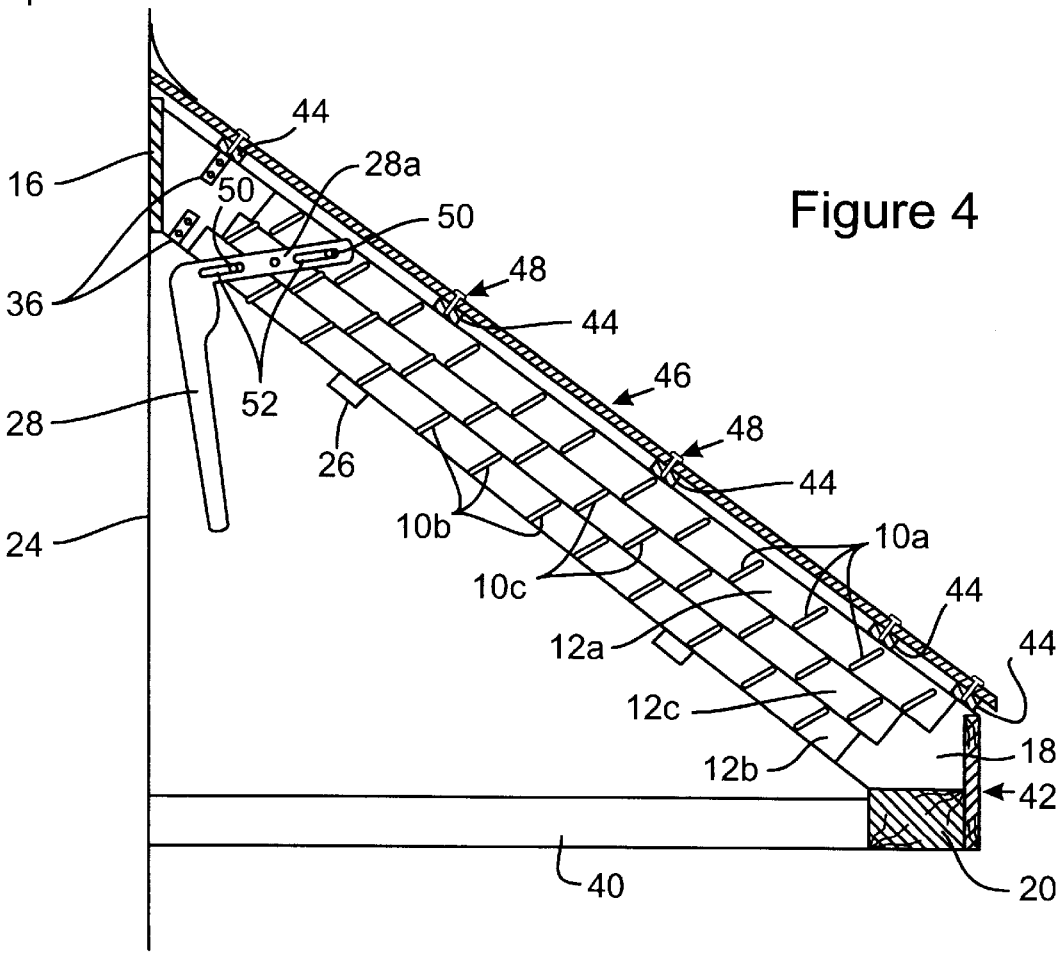
FIG. 4 shows a cut away end view of a sloping awning structure attached to a house with translucent roofing material applied above a bank of three louver sets. The center louver set is fixed and the other two are slidably movable.

The embodiment of the invention shown in FIG. 4 differs from that shown in FIGS. 2 and 3 principally in that:

(a) three louvers sets are incorporated in a bank rather than only two, (b) the awning structure is sharply sloped rather than horizontal, and (c) translucent roofing material is included to provide protection from rain and snow.

In FIG. 4 header 16 is attached to side of house 24. Rafter 18 is attached to header 16 at one end, and to beam 20 25 at the other end Beam 20 is attached to and supported by brace 40. Brace 40 is attached to beam 20 and to side of house 24. Trim board 42 provides a finished look to the front of the structure. Furring strips 44 are connected to the top edge of rafters 18. Furring strips 44 provide support for translucent, corrugated fiberglass roofing material 46. Fiberglass 46 is attached to furring strip 44 with roofing material fasteners 48. Center louver stringers 12*c* fit snugly between rafters 18 and are fixedly attached thereto. Slats 10*a* and 10*b* are slightly shorter than slats 10*c*. Therefore, stringers 12*a* and 12*b* fit slidably loosely between rafters 18. Stringers 12*a* rest and slide on stringers 12*c*. Stringers 12*b* rest and slide on stringer rests 26. Lever 28 is constructed with an angled extension 28*a*. Lever extension 28*a* is pivotally attached to the inner side of stringer 12*c*. Pins 50 protrude from the inner side of stringers 12*a* and 12*b*. Pins 50 extend through slots 52 slidably connecting stringers 12*a* and 12*b* to lever extension 28*a*.

When lever 28 is moved away from the house, stringers 12*a* are caused to slide upward on stringer 12*c* while stringers 12*b* are caused to slide downward on stringer rests 26. When Lever 28 is moved toward the house, stringers 12*a* and 12*b* are caused to slide in opposite directions. Stops 36 define the limits of these sliding movements. The position of the louver sets within the bank of louvers sets in relation to one another determines the amount of pass-through light. The application of the translucent or transparent roofing material allows light transmission while providing protection from rain and snow. Translucent and/or transparent material may also be applied to structures with less pitch and to structures which employ only two sets of louvers within each bank.

From the foregoing it can be clearly seen that the awning structure of my invention is simple, and economical to construct. Moreover, it can be adapted to many applications where an awning is desired that permits some control of the pass-through light.

I claim:

1. An awning structure comprising:

(a) at least two louver sets arranged one above the other, thus forming a bank of louver sets;

(b) each said louver set comprising a pair of upstanding stringers and a plurality of slats, each said slat having opposing ends, said slats being parallel to one another and spaced apart from one another, said opposing ends of said slats being affixed to said upstanding stringers so that said upstanding stringers define a plane and are spaced apart parallel to one another and perpendicular to said slats.

2. The awning structure of claim 1 wherein said at least two louver sets are arranged with said stringers of each said louver set proximate to and generally parallel to said stringers of adjacent said louver set(s) within said bank of louver sets.

3. The awning structure of claim 2 wherein at least one said louver set within said bank of louver sets is slidably movable in a longitudinal plane with said stringers of said slidably movable louver set(s) remaining generally parallel to said stringers of adjacent said louver set(s) within said bank of louver sets, whereby the position of said slats of said slidably movable louver set(s) relative to the position of said slats of other said louver set(s) within said bank of louver sets is adjustable, thus permitting regulation of light transmittal through said awning structure.

4. The awning structure of claim 3 having means for slidably moving said at least one slidably movable louver sets.

5. The awning structure of claim 3 further including a lever mechanism as said means for moving said slidably movable louver set.

6. The awning structure of claim 4 wherein said lever mechanism comprises:

(a) a lever, said lever having a fulcrum end pivotally attached to a stationary portion of said awning structure or building to which said awning structure is attached;

(b) an anchor, said anchor fixedly attached to a portion of said slidably movable louver set;

(c) a connecting link having opposing ends, one said opposing end of said connecting link being pivotally attached to said lever at a selected distance from said fulcrum pivot of said lever, other said opposing end of said connecting link being pivotally attached to said anchor, whereby orbital movement of said lever from said fulcrum pivot produces sliding movement of said slidably movable louver set, thus providing regulation of pass-through light.

7. The awning structure of claim 1 further including translucent or transparent material suitably affixed to said structure, whereby rain and snow are shed away from underneath said awning structure.

* * * * *